US007578707B2

(12) United States Patent
Stokoe et al.

(10) Patent No.: US 7,578,707 B2
(45) Date of Patent: Aug. 25, 2009

(54) MODULAR BOARD TO BOARD CONNECTOR

(75) Inventors: Philip T. Stokoe, Attleboro, MA (US); Edward C. Ekstrom, Merrimack, NH (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 11/854,231

(22) Filed: Sep. 12, 2007

(65) Prior Publication Data

US 2009/0068855 A1 Mar. 12, 2009

(51) Int. Cl.
*H01R 13/502* (2006.01)

(52) U.S. Cl. ..... 439/701

(58) Field of Classification Search ..... 439/701, 439/608, 378

See application file for complete search history.

(56) References Cited

U.S. PATENT DOCUMENTS

| | | | | |
|---|---|---|---|---|
| 4,655,518 | A | 4/1987 | Johnson et al. | |
| 4,686,607 | A | 8/1987 | Johnson | |
| 5,360,349 | A | 11/1994 | Provencher et al. | |
| 5,403,206 | A | 4/1995 | McNamara et al. | |
| 5,672,064 | A | 9/1997 | Provencher et al. | |
| 5,860,816 | A | 1/1999 | Provencher et al. | |
| 6,181,219 | B1 | 1/2001 | Gailus et al. | |
| 6,276,963 | B1 | 8/2001 | Avery et al. | |
| 6,530,790 | B1 | 3/2003 | McNamara et al. | |
| 6,565,387 | B2 | 5/2003 | Cohen | |
| 6,776,659 | B1 | 8/2004 | Stokoe et al. | |
| 6,827,611 | B1 | 12/2004 | Payne et al. | |
| 6,872,085 | B1 | 3/2005 | Cohen et al. | |
| 7,048,585 | B2 | 5/2006 | Milbrand, Jr. et al. | |
| 7,108,556 | B2 | 9/2006 | Cohen et al. | |
| 7,331,802 | B2 * | 2/2008 | Rothermel et al. | 439/108 |
| 7,338,321 | B2 * | 3/2008 | Laurx | 439/608 |
| 2006/0068640 | A1 | 3/2006 | Gailus | |

OTHER PUBLICATIONS

CIN::APSE "Proven in Land Grid Array (LGA) Applications" (c) 2003 Cinch Connectors, Inc., www.cinch.com, 2 pgs.

* cited by examiner

*Primary Examiner*—Jean F Duverne
(74) *Attorney, Agent, or Firm*—Blank Rome LLP

(57) ABSTRACT

A connector assembly has a receptacle module and a pin module that interconnect. Stiffener engagement projections and recesses are provided along the sides of the receptacle and pin modules in an alternating fashion. The recesses are sized and shaped to receive the stiffener engagement projections of a respective neighboring module. Stainless steel elongated stiffener plates removably engage the pin and receptacle modules in both an X-direction and/or a Y-direction. The stiffener plates have slots that extend partly through the plates and align with the stiffener engagement projections and receiving recesses. The slots receive respective ones of the projections of the neighboring pin and receptacle modules.

28 Claims, 13 Drawing Sheets

MODULAR BOARD TO BOARD CONNECTOR

BACKGROUND OF THE INVENTION

1. Field of the Invention

The present invention relates to board to board modular connectors. More particularly, the present modular connector invention permits the modular assembly of boards.

2. Background of the Related Art

Electrical connectors are used in many types of electronic systems. For example, in many computerized systems, printed circuit boards are joined together through connectors. One piece of the connector is attached to each board. The connector pieces are mated to complete many signal paths between the boards. In addition, the DC power or ground paths are also completed through the connector. The DC paths allow the printed circuit boards to be powered and, if configured appropriately, shield adjacent signal contacts to improve the integrity of signals passing through the connector. It is generally easier and more cost effective to manufacture a system on several printed circuit boards that are then joined together with electrical connectors.

Each half of the connector contains conducting contacts held in an insulative housing. Each contact has a contact region, which makes electrical contact to a contact in the other half of the connector when the connectors are mated. In addition, each contact has a tail portion which extends from the housing and is attached to a printed circuit board. The tail could be either a solder tail, which is soldered to the printed circuit board, or a press-fit tail, which is held by friction in a hole in a printed circuit board. The contact body carries the signal from the contact region to the tail.

One common type of signal contact simply uses a pin as the contact region. Pin contacts generally mate with receptacle type contacts. The contact area of a receptacle type contact is formed from a pair of parallel-cantilevered beams. The cantilevered beams generate a spring force against the pin, ensuring a good electrical contact. Other types of contacts can also used, such as contacts shaped as plates, blades or forks.

Connector housings are often molded from plastic. Initially, connector housings were molded in one piece. However, it is difficult to maintain the necessary tolerances for large surface mount connectors subject to high temperature gradients such that building large connectors from individual modules is easier.

SUMMARY OF THE INVENTION

Accordingly, it is an object of the invention to provide a modular board to board connector with X and Y scalability. It is a further object of the invention to provide boards connected by a stiffener that provides scalability in both an X and Y directions.

In accordance with these and other objectives, a connector or connector assembly is provided. The connector assembly has a receptacle module and a pin module that interconnect. Stiffener engagement projections are provided along the sides of the receptacle and pin modules. Recesses are also provided along the sides of the receptacle and pin modules. The recesses are sized and shaped to receive the stiffener engagement projections of a respective neighboring module.

Stainless steel stiffener plates removably engage the pin and receptacle modules in both an X-direction and/or a Y-direction. The stiffener plates have rectangular-shaped slots that extend partly through the plates and align with the stiffener engagement projections and receiving recesses of the pin and receptacle modules. The slots receive respective ones of the projections on the sides of the neighboring pin and receptacle modules. In the X-direction, the stiffener plates extend the length of multiple modules to engage the projections of those modules.

In the Y-direction, the projections on one side of each module are offset from the projections on the opposite side of that module, so that the projections do not align with those of a neighboring module. Thus, the stiffener plate receives the projections of neighboring modules in an alternating fashion. Accordingly, the stiffeners are able to engage connectors and their respective boards in a modular fashion in both the X-direction and the Y-direction.

These and other objects of the invention, as well as many of the intended advantages thereof, will become more readily apparent when reference is made to the following description, taken in conjunction with the accompanying drawings.

DETAILED DESCRIPTION OF THE PREFERRED EMBODIMENTS

Figure 1:
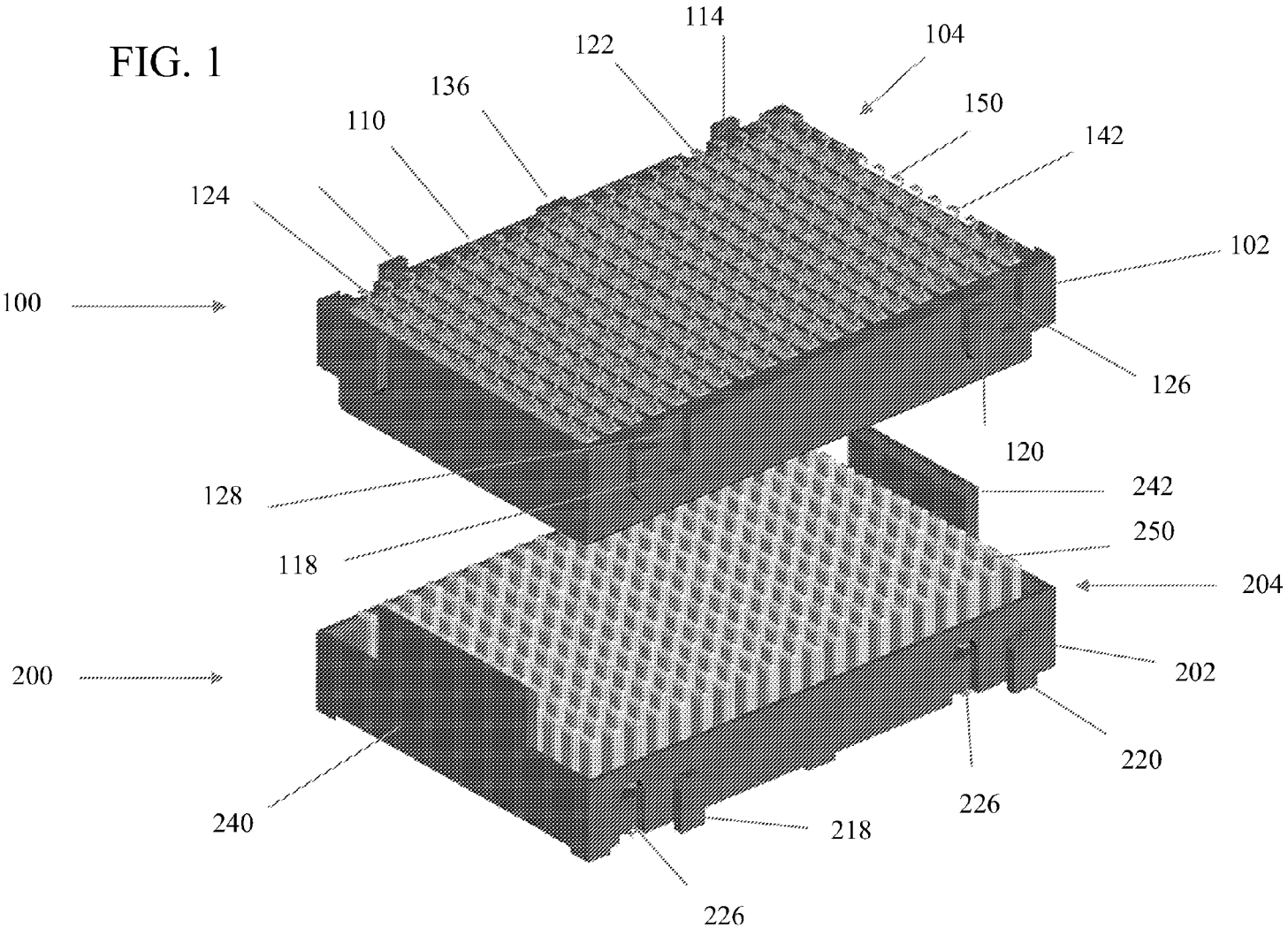
FIG. 1 is a perspective view of a connector assembly having a receptacle module and a pin module prior to connection in accordance with the preferred embodiment of the invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in a similar manner to accomplish a similar purpose.

Turning to the drawings, FIG. 1 shows a connector or connector assembly 10 in accordance with a preferred embodiment of the invention. The connector assembly 10 has a receptacle module 100 and a pin module 200 that interconnect. The receptacle module 100 has an insulated housing 102 that extends around the outer circumference of a contact section 104. The contact section 104 has receptacles fitted with contacts 150, which are shown in the embodiment of FIG. 1 as hook-type contacts. The insulated housing 102 is preferably a plastic material and has a rectangular or square shape, though other suitable materials and shapes can be utilized. The housing 102 includes openings for receiving the contacts 150 of the contact section 104.

The housing portion 102 has a first side 110 and a second side 112 opposite the first side. The housing 102 also has a first end 140 and a second end 142 opposite the first end 140. An engagement structure comprising stiffener engagement projections 114, 116 are provided along the first side 110 of the receptacle module 100, and stiffener engagement projections 118, 120 are provided along the second side 112 of the receptacle module 100. Each side 110, 112 of the housing 102 preferably has at least two stiffener engagement projections so that the module 100 connects to neighboring modules 100 toward each end 140, 142 of the module 100. However, only a single projection can be provided on each side, and more than two projections can also be used. In addition, it is possible for a projection to be utilized on only one side of the module 100.

Figure 4:
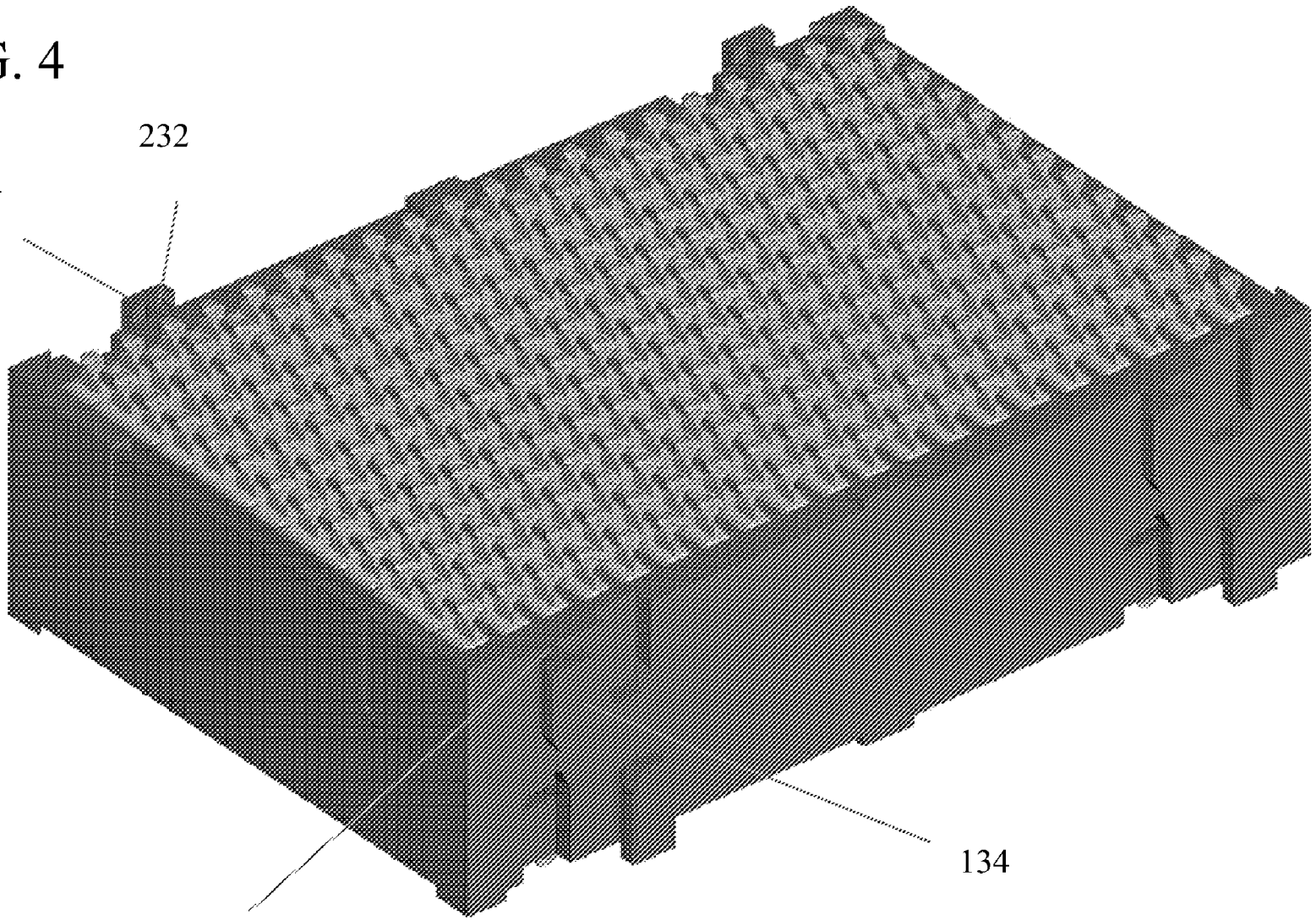
FIG. 4 is a perspective view of the connector assembly with the receptacle module connected to the pin module.

As best shown in FIG. 4, the projections 114, 116, 118, 120 each have a narrow base portion 132 that extends outward from the face of the side wall 110, 112. A wide head or top portion 134 is connected substantially perpendicular to the top of the base portion 132 to form a T-shaped cross-section. As depicted, the top portion 134 has one end that is flat and one end that is beveled along its sides.

Returning to FIG. 1, the first side 110 of the receptacle module 100 is also provided with recesses 122, 124, and the second side 112 of the receptacle module 100 is provided with engagement structures comprising recesses 126, 128. The recesses 122, 124, 126, 128 are sized and shaped to receive the stiffener engagement projections 114, 116, 118, 120. Thus, as best shown in FIG. 4, the receiving recesses 122, 124, 126, 128 are formed so a first end is straight and a second end has beveled sides. The beveled sides of the projections 114, 116, 118, 120 facilitate the top portion 134 being received by a respective receiving recess 122, 124, 126, 128 of a neighboring receptacle module 100. The recesses 122, 124, 126, 128 preferably extend about half way into the side walls 110, 112, though can extend less or more or all the way through the side walls. A stand off 136 is provided along the sides 110, 112 of the receptacle module 100. The receptacle module 100 receives a printed circuit board ("PCB" or just "board") on the side facing away from the pin module 200. The stand off 136 controls the amount of stress the hook like leads may be subject too during the attachment process.

Figure 2:
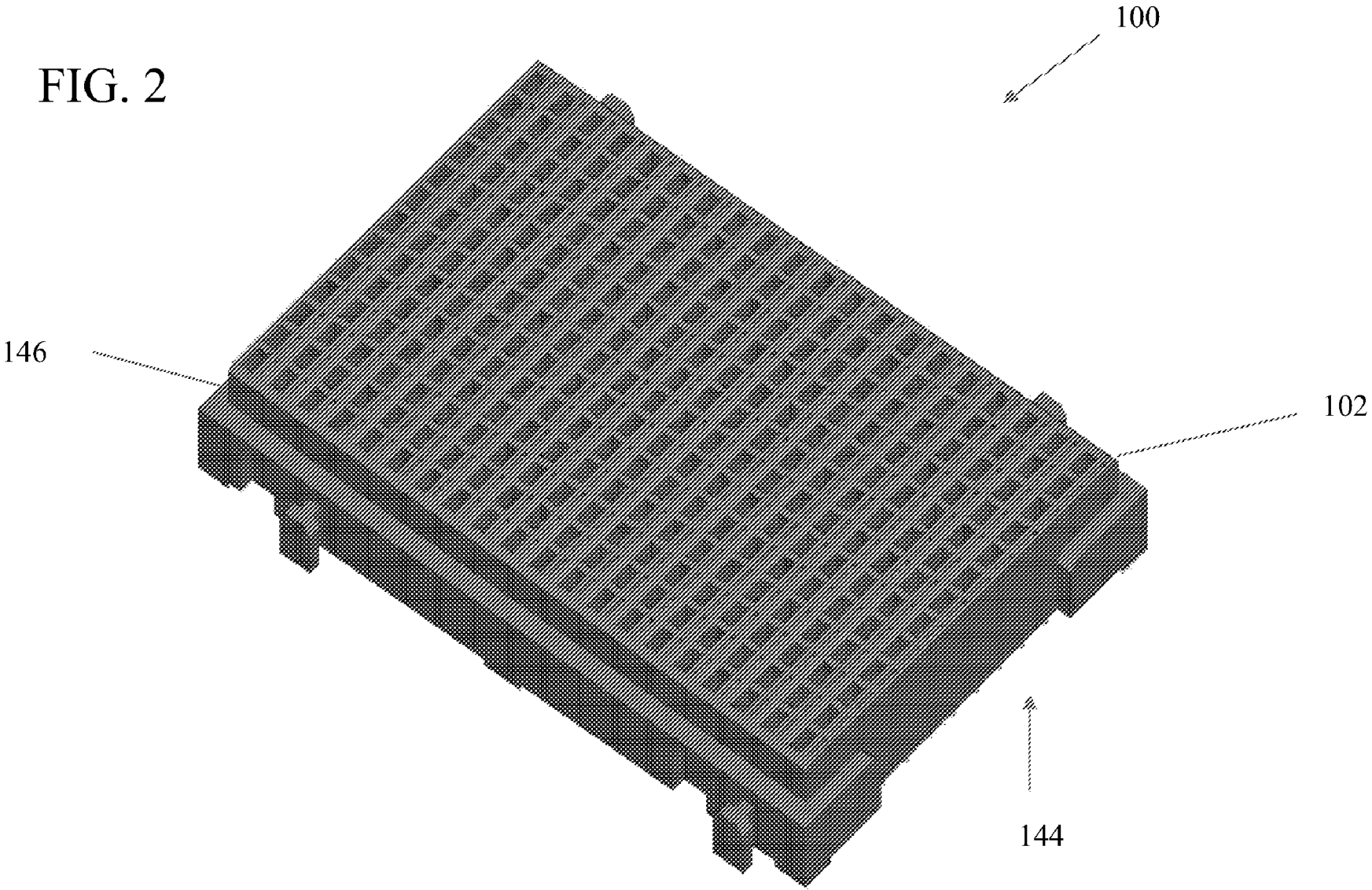
FIG. 2 is a perspective bottom view of the receptacle module.

Referring to FIG. 2, an opening 144 is located at each of the first and second ends 140, 142 of the receptacle module 100. The housing 102 also has a recessed portion 146 at the bottom of the receptacle module 100 that engages a respective configuration of the pin module 200.

The pin module 200 has an insulated housing 202 that extends around the outer circumference of a contact section 204. The contact section 204 has receptacles fitted with contacts 250, which are shown in the embodiment of FIG. 1 as pin contacts. The insulated housing 202 is preferably a plastic material and has a rectangular or square shape, though other suitable materials and shapes can be utilized. The housing 202 includes openings for receiving the contacts 250 of the contact section 204.

The housing portion 202 has a first side 210 and a second side 212 opposite the first side 210. The housing 202 also has a first end 240 and a second end 242 opposite the first end 240. Stiffener engagement projections 214, 216 are provided along the first side 210 of the pin module 200, and stiffener engagement projections 218, 220 are provided along the second side 212 of the pin module 200. Each side 210, 212 of the housing 202 preferably has at least two stiffener engagement projections so that the module 200 connects to neighboring modules 200 toward each end 240, 242 of the module 200. However, only a single projection can be provided on each side, and more than two projections can also be used. In addition, it is possible for a projection to be utilized on only one side of the module 200.

As best shown in FIG. 4, the projections 214, 216, 218, 220 each have a narrow base portion 232 that extends outward from the face of the side wall 210, 212. A wide head or top portion 234 is connected substantially perpendicular to the top of the base portion 232 to form a T-shaped cross-section. As depicted, the top portion 234 has one end that is flat and one end that is beveled along its sides.

Returning to FIG. 1, the first side 210 of the pin module 200 is also provided with recesses 222, 224, and the second side 212 of the pin module 200 is provided with recesses 226, 228. The recesses 222, 224, 226, 228 are sized and shaped to receive the stiffener engagement projections 214, 216, 218, 220. Thus, as best shown in FIG. 4, the recesses 222, 224, 226, 228 are formed so a first end is straight and a second end has beveled sides. The beveled sides of the projections 214, 216, 218, 220 facilitate the top portion 234 being received by respective recesses 222, 224, 226, 228 of a neighboring pin module 200. The recesses 222, 224, 226, 228 preferably extend about half way into the side walls 210, 212, though can extend less or more or all the way through the side walls. A stand off 236 is provided along the sides 210, 212 of the pin module 200. The pin module 200 receives a PCB on the side facing away from the receptacle module 100, and the stand off 236 controls the stress the hook like leads may be subject to during the attachment process.

Figure 3:
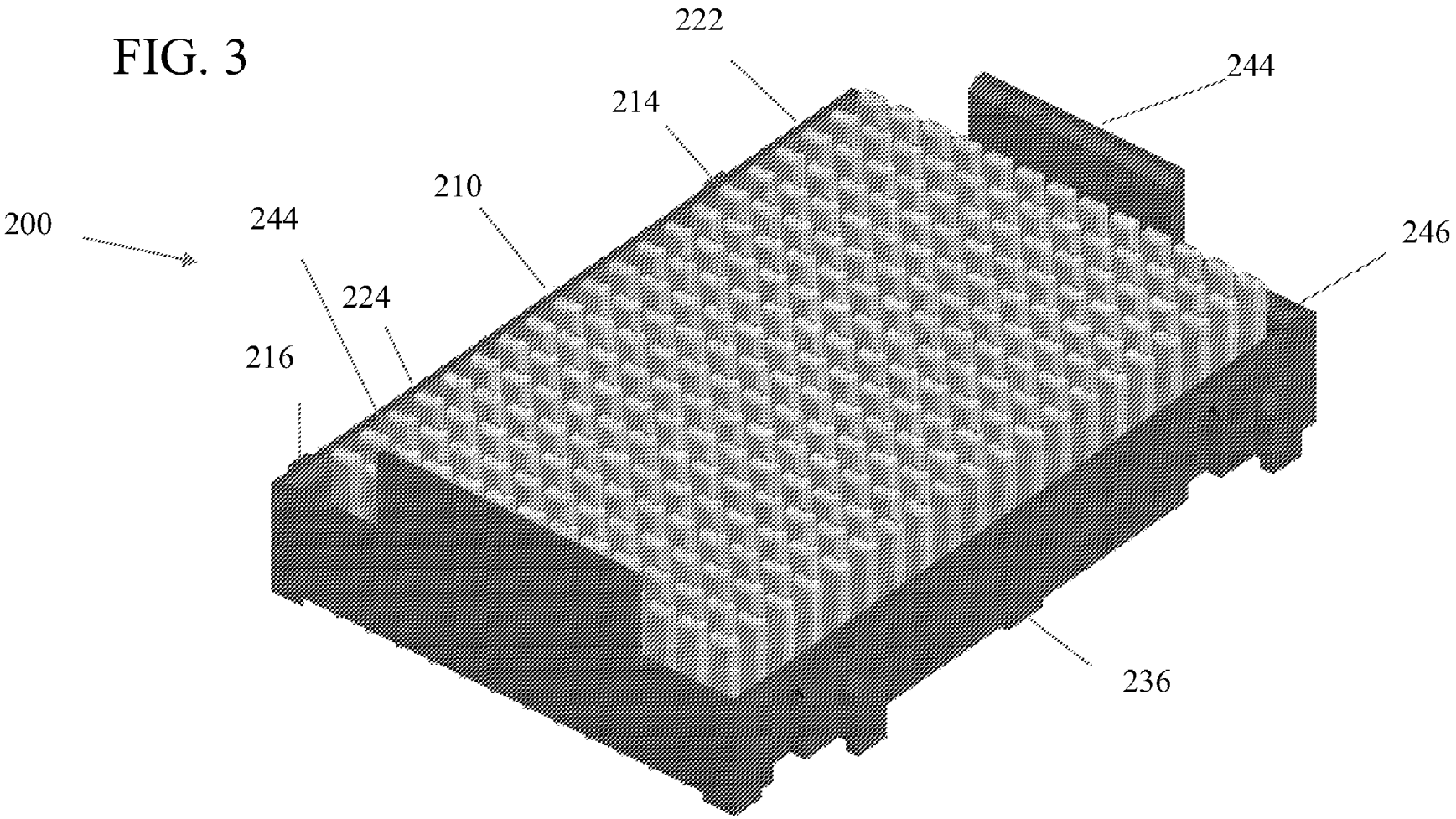
FIG. 3 is perspective top view of the pin module.

Referring to FIG. 3, the first and second ends 240, 242 of the pin module 200 have upright alignment tab portions 244. The housing 202 also has a narrowed inner portion 246 at the top of the pin module 200 that engages the recessed portion 146 of the receptacle module 100. The narrowed inner portion 246 has a beveled face.

As shown in FIG. 4, the receptacle module 100 mates with the pin module 200 such that the contacts 250 of the pin module 200 electrically engage the contacts 150 of the receptacle module 100. The tab portions 244 of the pin module 200 are slidably received in the opening 144 of the receptacle module 100. The tab portion 244 and opening 144 pre-align the pin module 200 with the receptacle module 100 to initially align the respective contacts 150, 250. The top of the tabs 244 are tapered, so that if the bottom of the receptacle module 100 come into contact with them, they move inward to better align with the pin module 200. The tab portions 244 and openings 144 are offset on the end walls 140, 142 and 240, 242 to ensure that the receptacle module 100 and the pin module 200 are properly aligned in the correct direction and position.

As the receptacle module 100 and pin module 200 come closer and the housings 102, 202 contact one another, the narrowed inner portion 246 of the pin module 200 receives the recessed portion 146 of the receptacle module 100, as also shown in FIGS. 17(*a*) and (*b*). The beveled face of the inner portion 246 facilitates alignment of the respective contacts 150, 250 of the modules 100, 200. The narrowed inner portion 246 and recessed portion 146, as well as the contacts 150, 250, form a snug friction fit between the modules 100, 200. The portions 246, 146 also form the final alignment of the receptacle module 100 and pin module 200 and align the bottoms of the receptacle contacts 150 with the tops of the pin contacts 250.

Further to the preferred embodiment, the receptacle module 100 and the pin module 200 each have a length of about 27.3 mm and a width of about 18.4 mm. And, there are 20 rows and 13 columns of contacts 150, 250. However, the dimensions and number of contacts are not intended to limit the invention. The modules 100, 200 can have any suitable dimensions and number of rows and columns, either greater or less than the preferred embodiment, while still falling within the scope of the invention.

Figure 5:
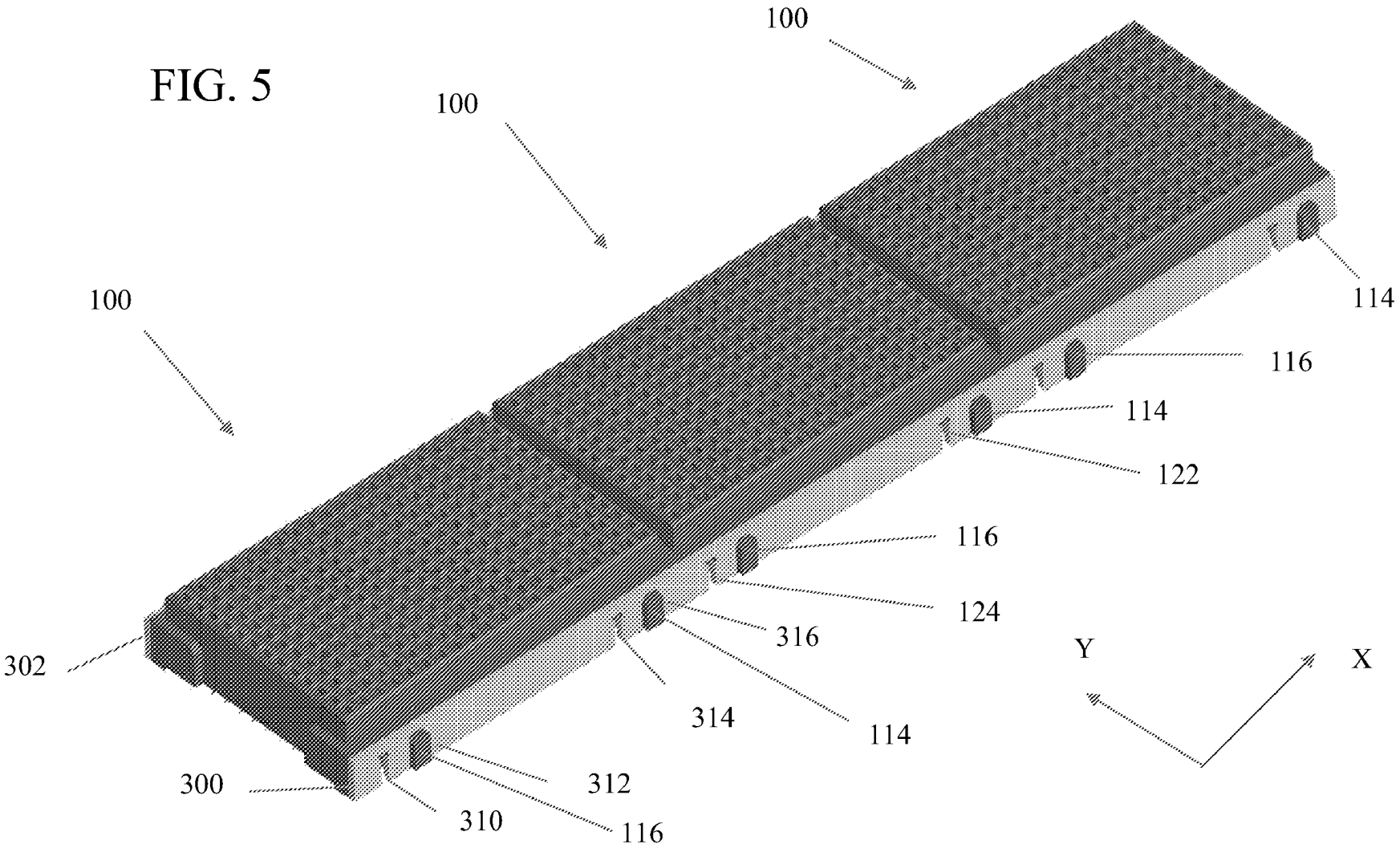
FIG. 5 is a perspective bottom view of three receptacle modules in an in-line configuration.

In FIG. 5, the modularity of the system 10 is shown in the X-direction. Three receptacle modules 100 are illustrated having an in-line configuration. Stainless steel elongated stiffener plates 300, 302 removably engage the modules 100. Though three modules 100 are shown in the embodiment of FIG. 5 connected by two stiffeners 300, 302, two or more modules 100 can be connected by the stiffeners 300, 302 as suitable for a particular application. In addition, though in the preferred embodiment the stiffeners 300, 302 extend the entire length of the three modules 100, more than one stiffener 300, 302 can be provided along each side of the modules 100. Thus, for instance, two stiffeners (each about one-half the length of the stiffener 300) can replace the single stiffener 300. Or, two shortened stiffeners can be used, one that connects the projection 118 of the first (nearest in the embodiment of FIG. 5) module 100 with the projection 120 of the second (middle) module 100; and a second one that connects the projection 118 of the second module 100 with the projection 120 of the third (rear) module 100.

In the embodiment shown, the modules 100 are connected in a single in-line configuration to have X-direction scalability. The stiffener plates 300, 302 have rectangular-shaped slots 310, 312, 314, 316 that extend partly through the plates 300, 302 and align with the stiffener engagement projections and receiving recesses of the modules 100, 200. The slots 312, 316 receive respective ones of the projections 114, 116 on the first side 110 of the modules 100. The slots 310-316 are slightly wider than the thickness of the base portions 132, 232 but narrower than the width of the top portions 134, 234 of the projections 114, 116. Accordingly, the base portions 132 of the projections 114, 116 are slidably received in a respective slot 316, 312 of the stiffener 300. The stiffener 302 is likewise removably connected to the projections 118, 120 on the second side 112 of the receptacle module 100. Since the slots of the stiffener are narrower than the top portions 134, the projections cannot pull free from the stiffener if the stiffener is pulled in a direction away from the module 100.

Figure 6:
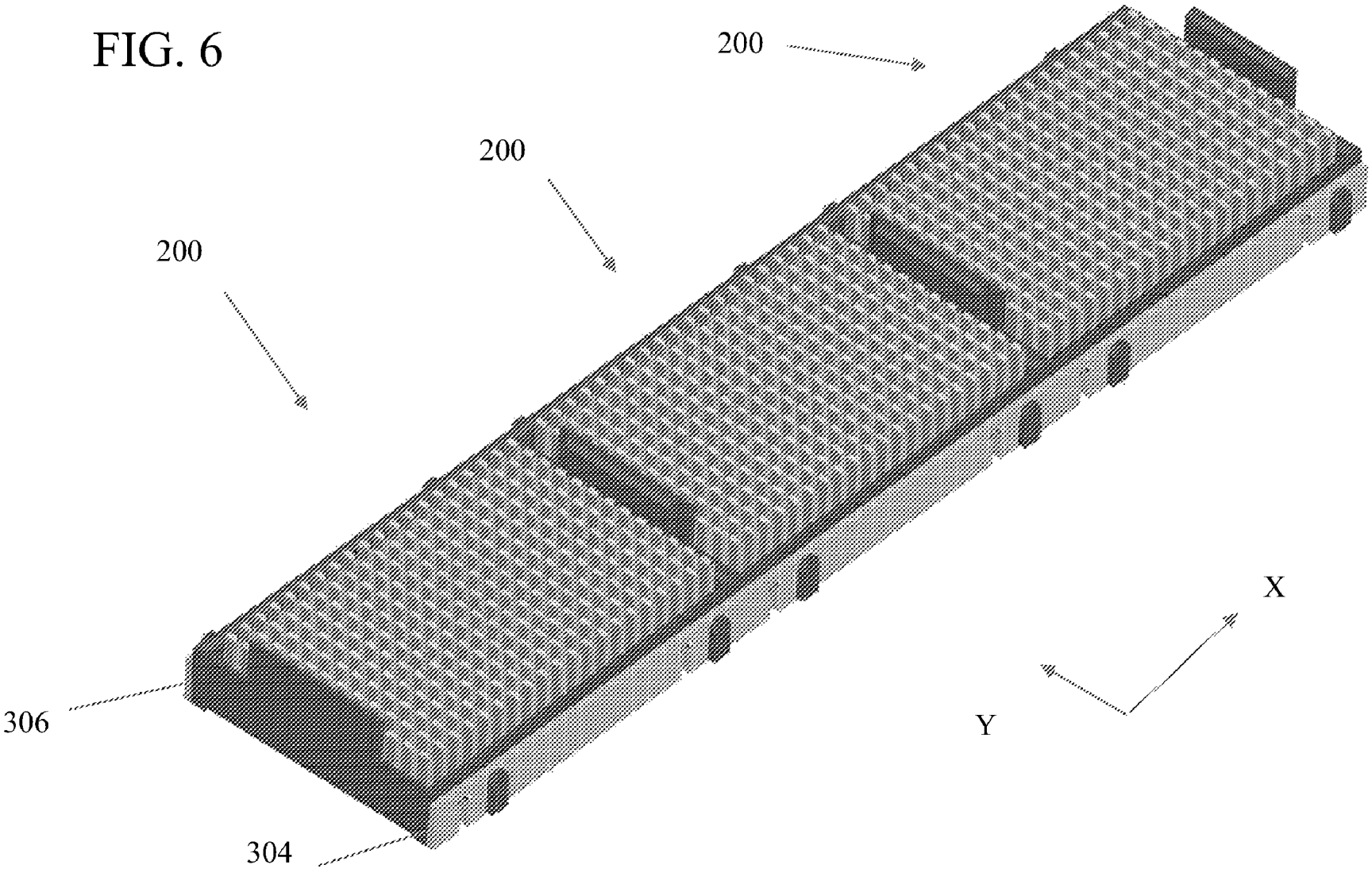
FIG. 6 is a perspective top view of three pin modules in an in-line configuration.

In FIG. 6, the pin modules 200 are also shown in an in-line configuration. Stiffeners 304, 306 connect the modules 200 together. The stiffeners 300, 302, 304, 306 are all made of stainless steel, having a similar coefficient of expansion as a typical printed circuit boards ("PCB") that connect to the modules 100, 200. In this way, the stiffeners 300, 302, 304, 306 expand and contracts significantly the same as the PCB to maintain the system 10 alignment integrity under various thermal conditions providing precise surface mount contact lead to PCB pad alignment. The metal stiffeners can be made with greater accuracy than a similar sized housing can be molded.

Because the modules 100, 200 are made from plastic and the PCB materials have a different coefficient of expansion than the modules 100, 200, the modules 100, 200 and the PCBs would create an unacceptable SMT lead alignment, especially as the connector/modules become larger in size. The stiffeners 300-306 have substantially similar coefficients of expansion as the PCB. Thus, the modules 100, 200 are sized to minimize the thermal expansion in the X and Y axis and are assembled to stiffeners 300, 302, 304, 306. The expansion of the connector under various thermal conditions are controlled by stiffeners 300, 302, 304, 306 in the X axis. When multiple modules 100, 200 are assembled with stiffeners 300, 302, 303, 304, 306 in the Y axis (FIG. 8), the stiffener engagement projection 114, 116, 118, 120 and recesses 122, 124, 126, 128 accommodate expansion and contractions under any thermal conditions.

Figure 7:
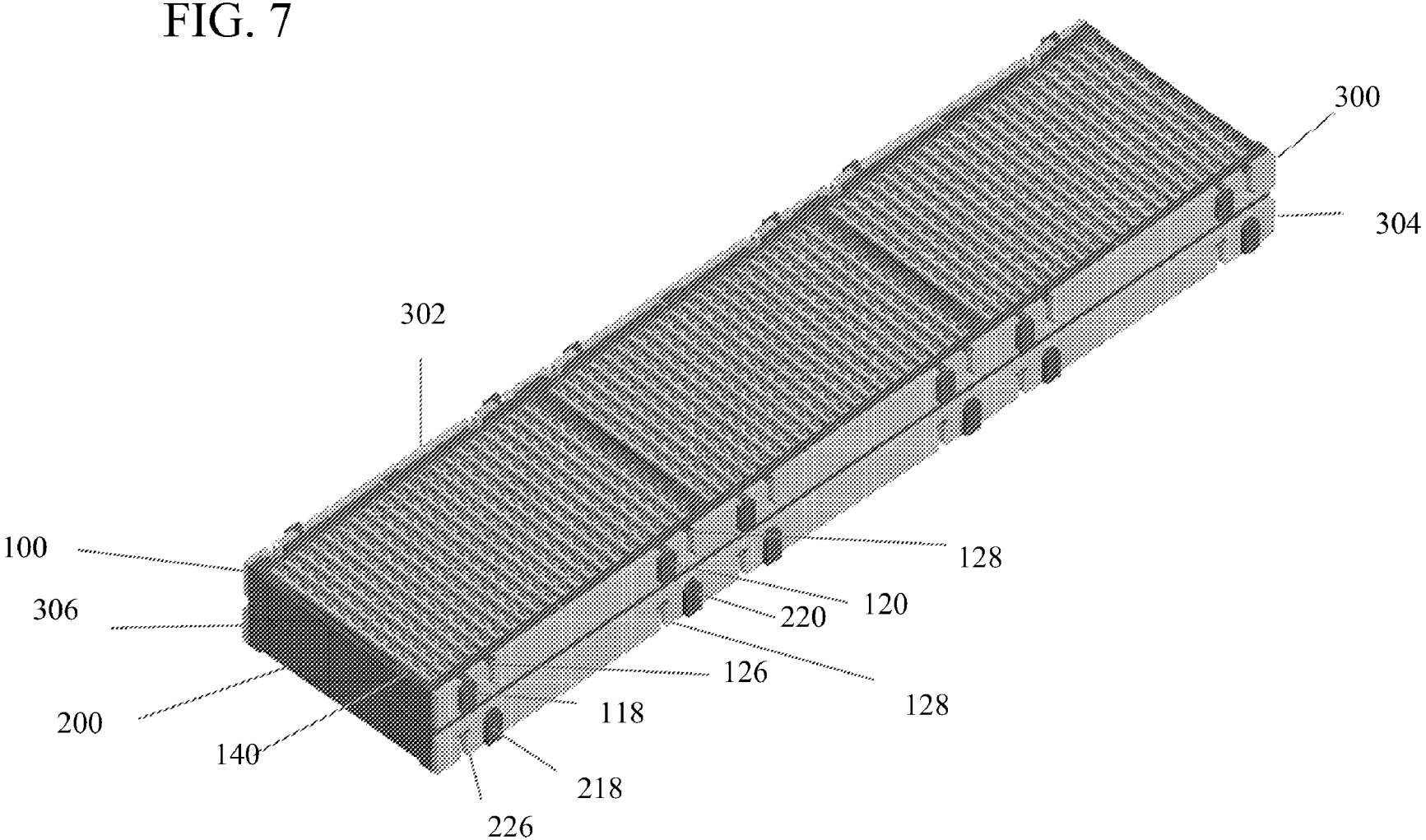
FIG. 7 is a perspective top view of three pin modules connected to three receptacle modules in an in-line configuration.

FIG. 7 shows the modules 100, 200 in an in-line configuration, with the receptacle modules 100 connected to the pin modules 200. As shown, the projections 118, 120 and the recesses 128, 126 of the receptacle modules 100 are in reverse positions than the projections 218, 220 and the recesses 228, 226 of the pin modules 200, respectively. Thus, for instance, while the receptacle module 100 has a projection 126 located closes to the first end 140, the pin module 200 has a recess 226 located closest to the first end 240. Accordingly, the projections 118, 120 on the second side 112 of the module 100 will align and mate with the mating recesses 122, 124 on the first side 110 of a neighboring module 100 in the Y-direction. And, the projections 114, 116 on the first side 110 of a module 100 will align and mate with the mating recesses 126, 128 on the second side 112 of a neighboring module 100 in the Y-direction.

In addition, the stiffeners 300, 302 of the receptacle modules 100 are inverted with respect to the stiffeners 304, 306 of the pin modules 200. Thus, the slots 310, 312, 314, 316 of all the stiffeners 300, 302, 304, 306 face outward, i.e., in the embodiments shown, the slots on the top open upwardly and the slots on the bottom open downwardly. In that manner, the stiffeners 300, 302, 304, 306 cannot be removed from the modules 100, 200 while the receptacle modules 100 are connected to the pin modules 200. Yet, the individual modules 100, 200 can be separately added to or removed from the stiffeners and repaired or replaced, if necessary.

It should be appreciated, however, that the stiffeners, engagement projections and their receiving recesses could be readily configured so that the individual modules 100, 200 cannot be removed unless the entire stiffener connecting all the modules is removed. It should further be noted that the stiffeners 300, 302 are identical to each other. Namely, the slots in each of the stiffeners 300, 302 are at the same position along the stiffeners. Thus, the stiffeners are interchangeable with one another, which reduces cost of manufacturing and ease of use.

Figure 8:
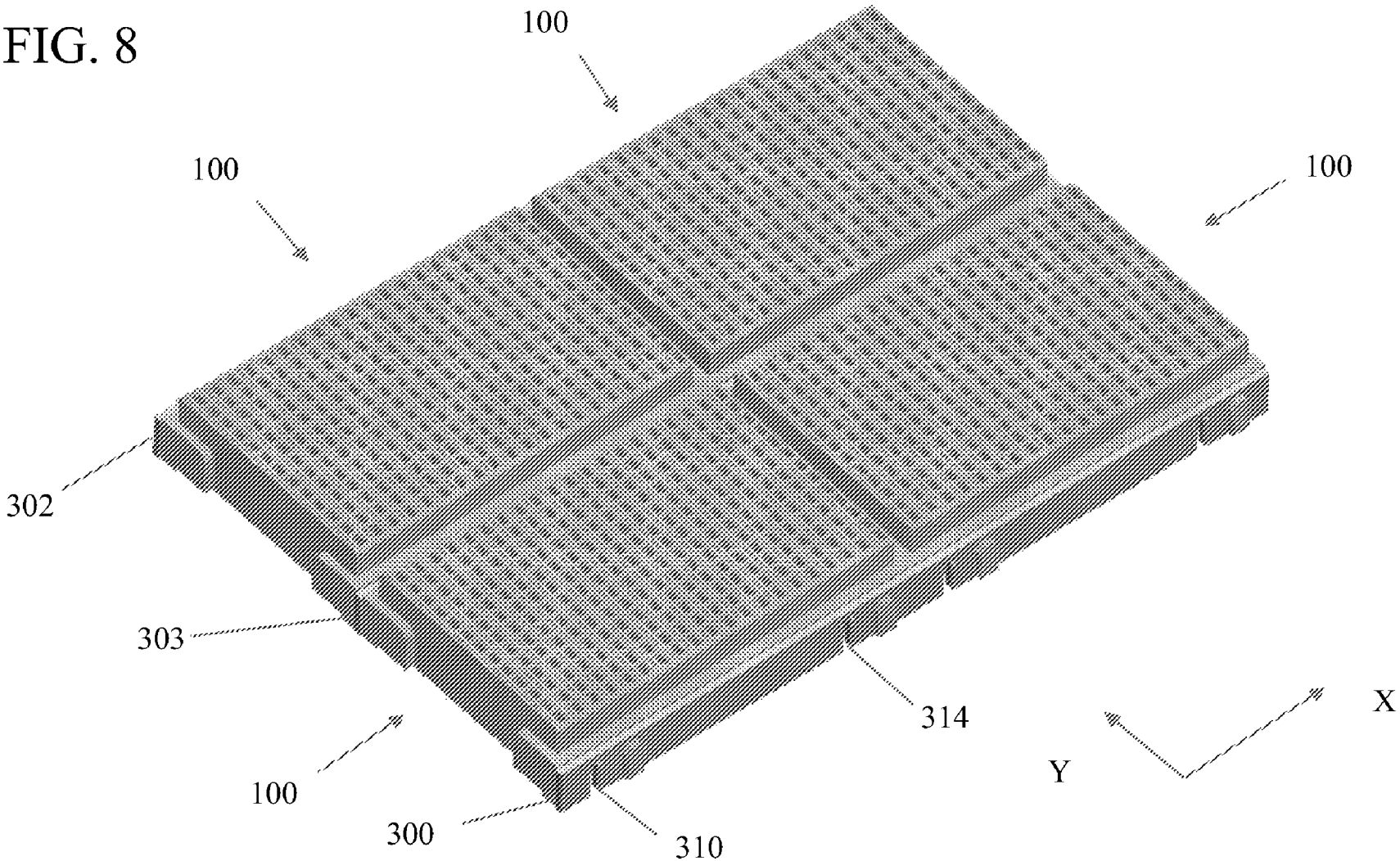
FIG. 8 is a perspective bottom view of a quad configuration of receptacle modules.

In FIG. 8, four receptacle modules 100 are connected in a 2×2 quad configuration to illustrate the X and Y scalability of the invention. Three stiffeners 300, 302 are provided to connect the modules 100. Because the projections 118, 120 and recesses 126, 128 along the first side 110 of the modules 100 are reversed with respect to the projections 114, 116 and recesses 122, 124 along the second side 112 of the modules 100, a single stiffener 303 is utilized to connect the modules 100 to one another in the Y-direction (best shown in FIG. 10). Additional modules 100 can be connected to the unused slots 310, 314 of the stiffeners 300, 302 to further expand the configuration in the Y-direction. The figure further illustrates the use of the stiffeners 300, 302, 303 connecting two modules 100 in the X-direction. It should be appreciated that any number of modules can be connected together to form arrays of different dimensions as suitable for a particular application, within the scope of the present invention. The invention is most useful, however, in the preferred embodiment where there are at least two modules in each of the X and Y directions, i.e., the quad configuration shown.

Figure 9:
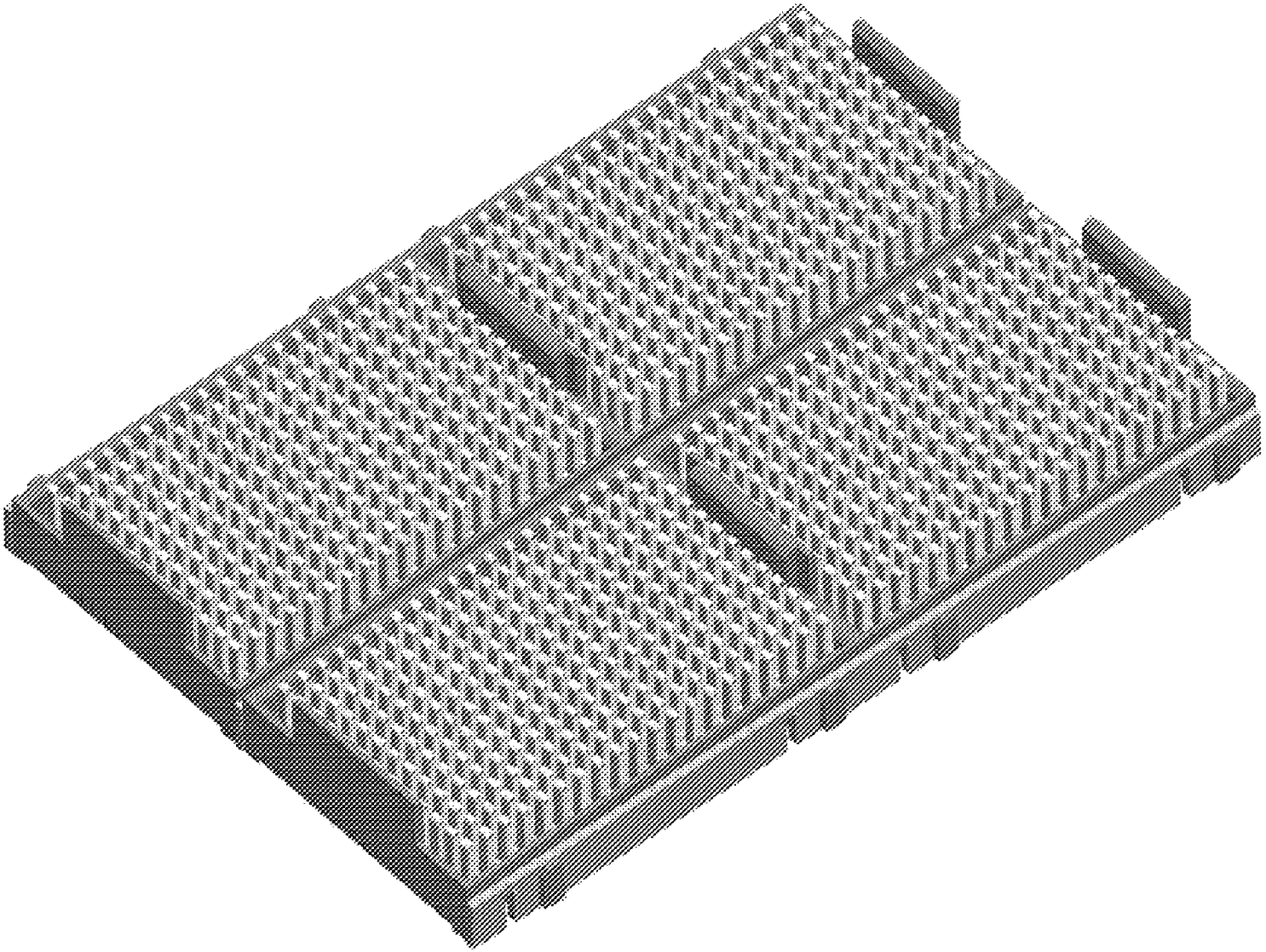
FIG. 9 is a perspective top view of a quad configuration of the pin modules.
Figure 10:
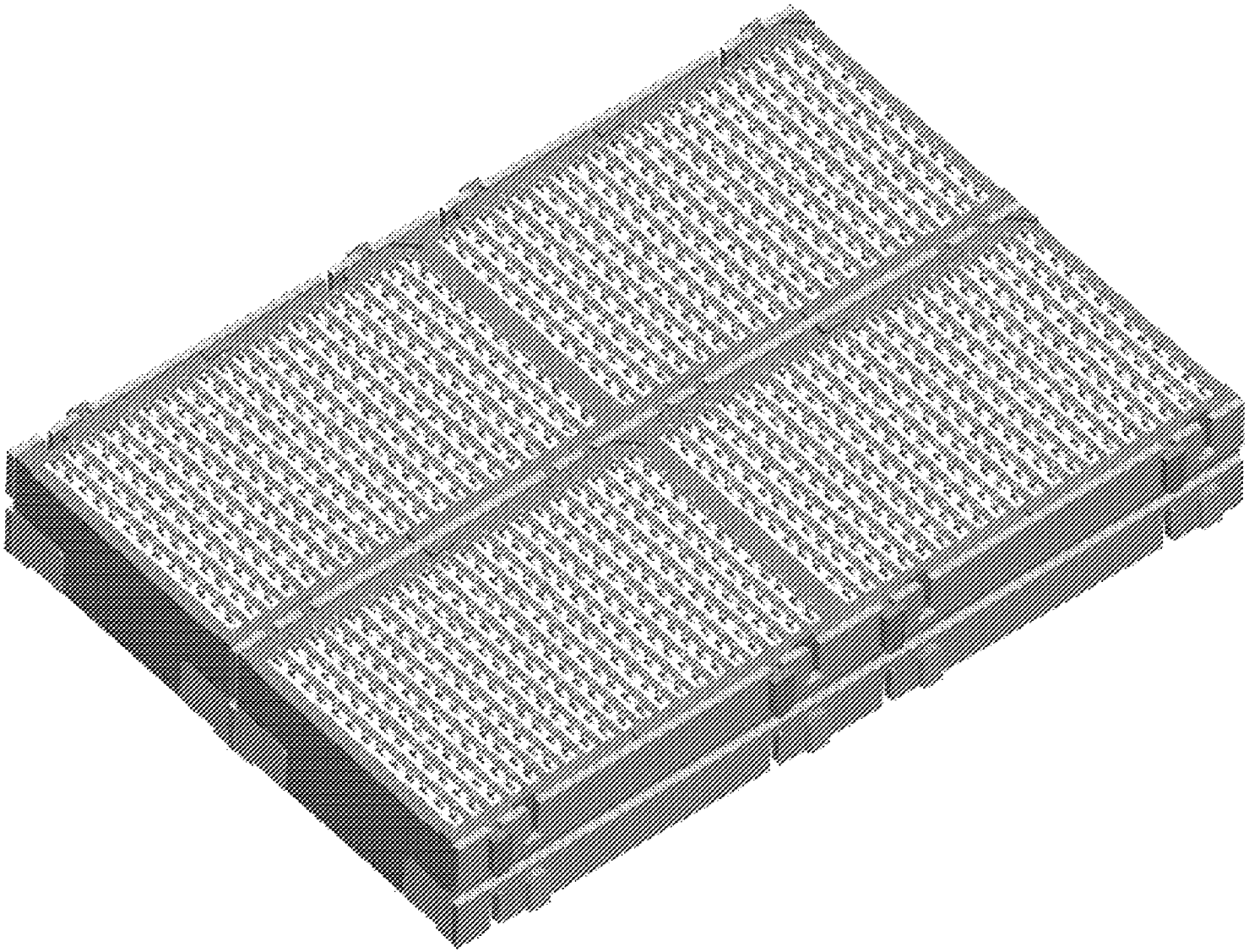
FIG. 10 is a perspective top view of a quad configuration of the receptacle modules connected to the pin modules.
Figure 12:
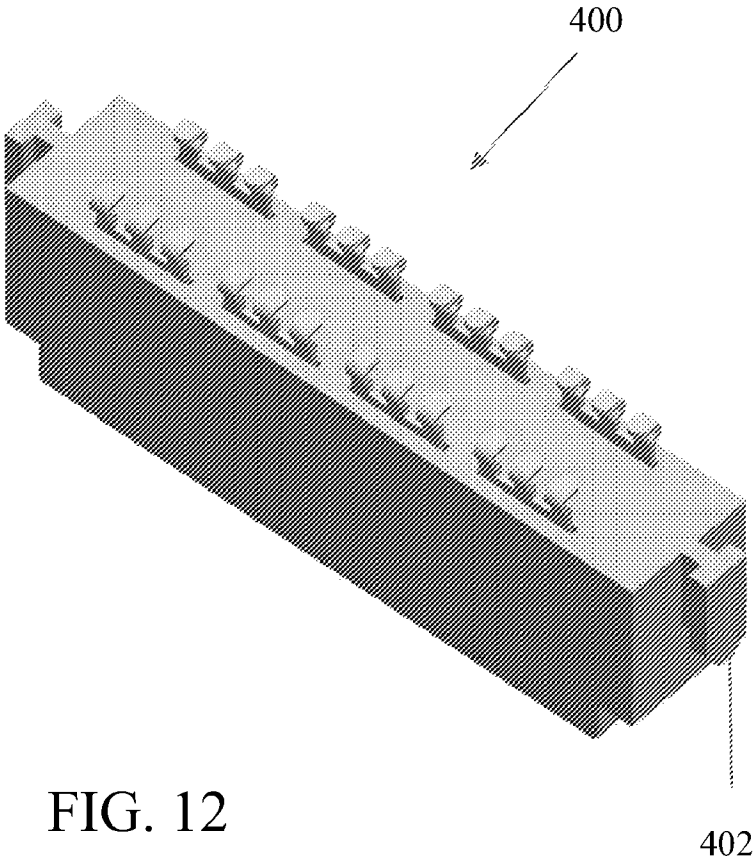
FIG. 12 is a top view of the power module of FIG. 11.
Figure 11:
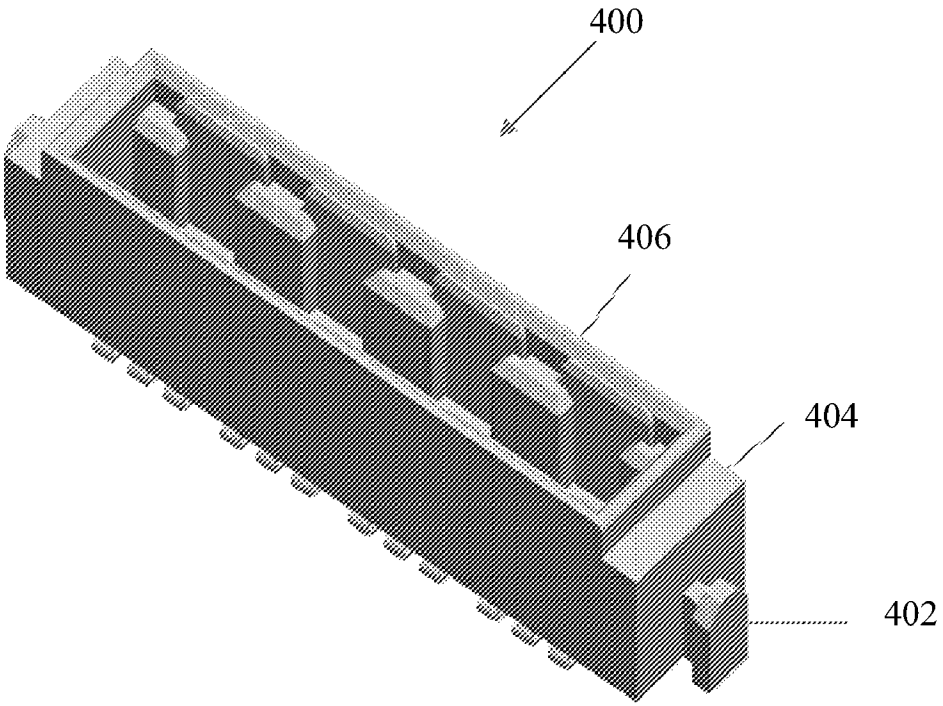
FIG. 11 is a bottom view of a power module used with the pin module.
Figure 14:
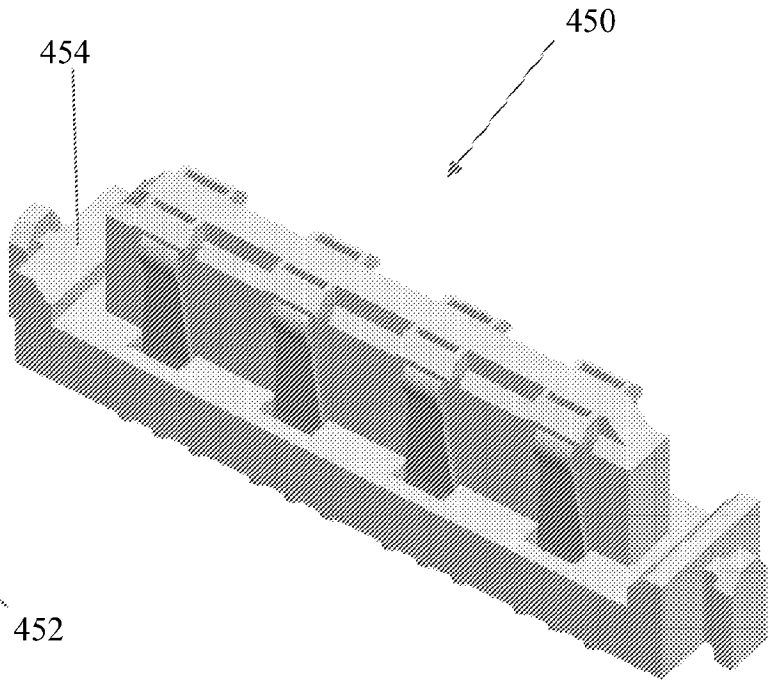
FIG. 14 is a bottom view of the power module of FIG. 13.
Figure 13:
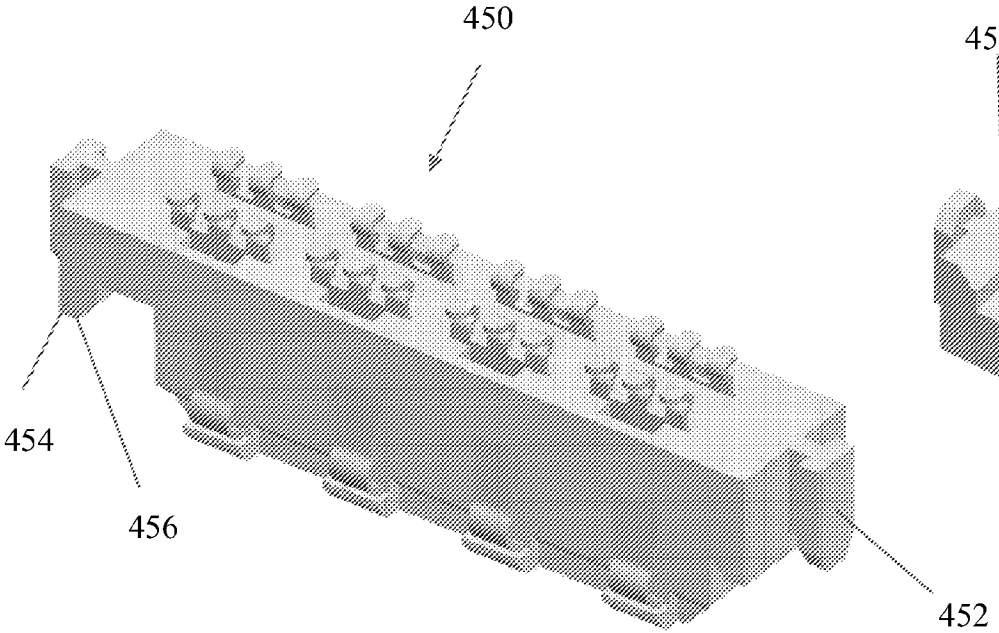
FIG. 13 is a top view of a power module used with the receptacle module.

FIG. 9 illustrates four pin modules 200 connected in a 2×2 quad configuration and FIG. 10 illustrates the quad receptacle modules 100 of FIG. 8 connected to the quad pin modules 200 of FIG. 9. FIG. 10 shows the projections of the receptacle modules 100 engaged in the mating recesses of the neighboring receptacle modules 100 in the Y-direction.

The invention can also be used to connect modules having smaller dimensions than the receptacle and pin modules 100, 200 of FIGS. 1-10, or to connect modules of different sizes and shapes. For instance, the invention can be utilized with the modules 400, 450 shown in FIGS. 11-14. In addition, the modules 400, 450 are power modules that are especially useful to connect with the receptacle and pin modules 100, 200 because the power modules 400, 450 provide the power necessary to drive and operate the receptacle and pin modules 100, 200.

FIGS. 11-14 show that the power modules 400, 450 each have a projection 402, 452 along each of two opposing sides. The power module 400 (FIGS. 11-12) is utilized to provide power to one or more pin modules 200, and the power module 450 (FIGS. 13-14) provides power to one or more receptacle modules 100. The top of the pin power module 400 has a ledge 404 forming a tab 406. The bottom of the receptacle power module 450 has a downwardly extending sidewall 454 having a beveled inward face 456.

Figure 15:
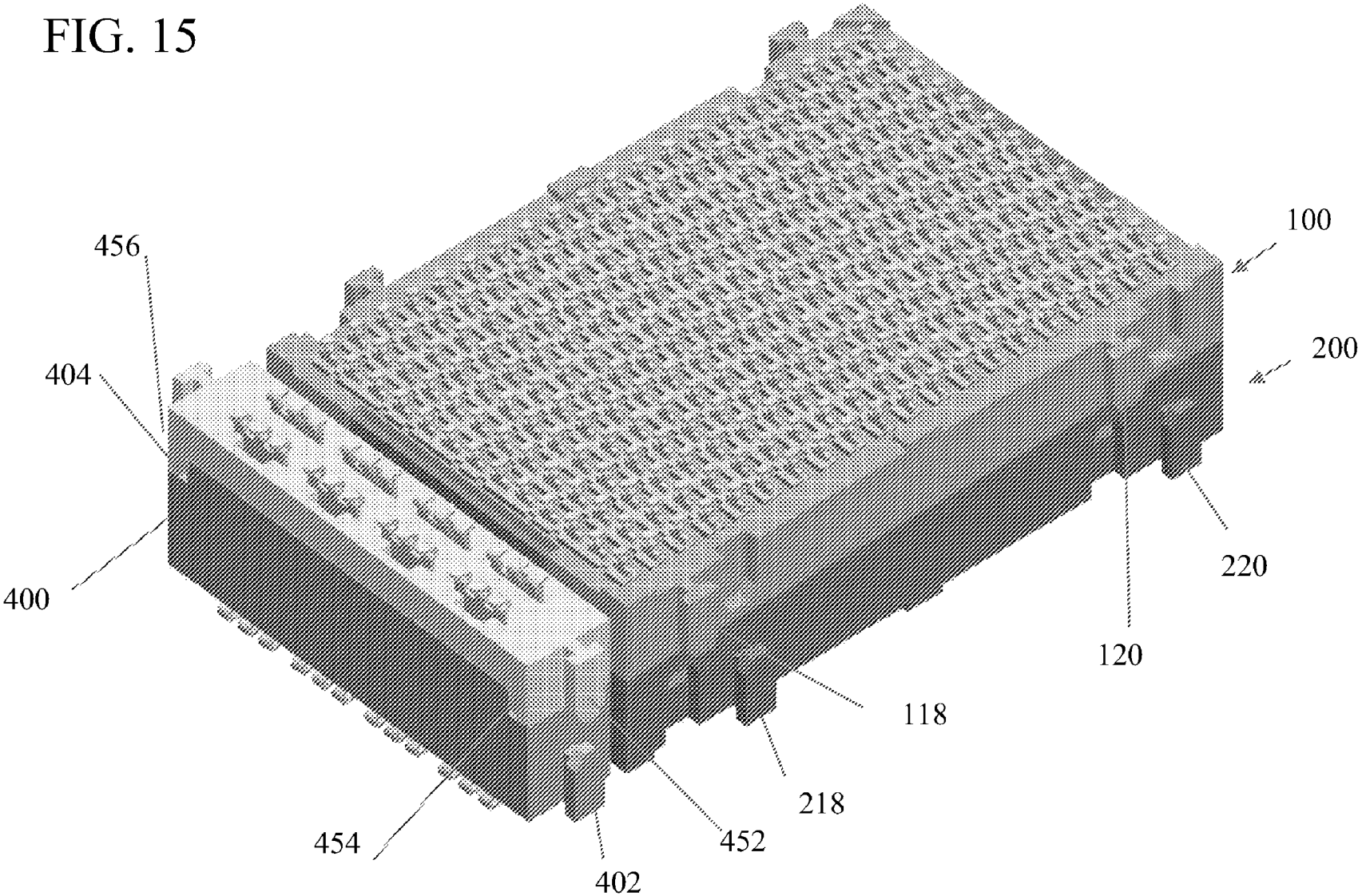
FIG. 15 is a top perspective view of the receptacle module and pin module with their respective power modules.

In FIG. 15, the receptacle power module 450 is connected to the pin power module 400. The ledge 404 of the pin power module 400 receives the downward extending sidewall 454 of the receptacle power module 450. Thus, the tab 406 of the pin power module 400 is received within the sidewall 454 of the receptacle power module 450. The beveled face 456 facilitates connection by pre-aligning the power modules 400, 450 with each other prior to connection.

As illustrated in the embodiment shown, the combined power modules 400, 450 are positioned adjacent to the modules 100, 200 so that the power module projections 402, 452 are aligned with the projections 118, 218 of the modules 100, 200. A stiffener (not shown) can then be connected to the power modules 400, 450 and to the receptacle and pin modules 100, 200. The power modules 400, 450 can connect to one of the standard slots located in the stiffener. Or, an additional slot(s) can be provided in the stiffener to accommodate one or more modules that may have different spacing requirements for the slots, such as the power modules 400, 450 of the present embodiment. One or more sets of power modules 400, 450 may be provided for one or more receptacle and pin modules 100, 200. For instance, the quad configurations of FIGS. 8-10 can be provided with up to 4 sets of power modules 400, 450, i.e., one for each receptacle and pin module 100, 200.

As has been shown, the invention provides X and Y scalability for flexibility in expanding module connections, replacing or repairing damaged modules, and is configurable to meet signal density needs. The stiffeners also reduces coefficient of expansion mismatch between PCBs and pin and receptacle modules. This is especially important during reflow where the heating and cooling at different rates than solder creates stress due to the mismatch in the coefficient of expansion. Additionally the design of hook like lead having a level of compliancy further reduces the stress transferred to the solder joint. Though the invention is illustrated in the figures with single ended contacts, it can also be utilized for differential contacts.

Further to the preferred embodiment, the modules 100, 200 are each approximately 24 mm long by about 15 mm wide, and the stiffeners 300-306 are each about 44 mm long, 2 mm wide, and about 0.5 mm thick. However, any suitable size and shape modules and stiffeners can be utilized without departing from the spirit and scope of the invention.

The foregoing description and drawings should be considered as illustrative only of the principles of the invention. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

We claim:

1. A connector assembly comprising:

a first module having a first side with an engagement structure, a second side, and a first contact section;

a second module having a second contact section and a first side with an engagement structure, wherein the first side of said second module is aligned with the first side of said first module along a first plane;

a third module having a third contact section, a first side with an engagement structure and a second side, wherein the second side of said third module is aligned with the second side of said first module along a second plane, and wherein the first, second and third contact sections are coplanar; and, an elongated plate having a first engagement structure removably engaging the engagement structure of said first module, a second engagement structure removably engaging the engagement structure of said second module, and a third engagement structure removably engaging the engagement structure of said third module.

2. The connector assembly of claim 1, further comprising a fourth module having a first side with an engagement structure and a second side, and said second module having a second side, wherein the first side of said fourth module is aligned with the second side of said second module along the second plane and the second side of said fourth module is aligned with the first side of said third module, said elongated plate further having a fourth engagement structure removably engaging the engagement structure of said fourth module.

3. The connector assembly of claim 1, wherein the first plane comprises substantially horizontally and said second plane comprises substantially vertically.

4. The connector assembly of claim 1, wherein the first plane is substantially perpendicular to the second plane.

5. The connector assembly of claim 1, wherein the first side of each of the first, second, and third modules is substantially perpendicular to the second side of each of the first, second and third modules, respectively.

6. The connector assembly of claim 1, wherein the first, second and third modules each have a body formed of an insulative material.

7. The connector assembly of claim 1, wherein the first, second and third modules each have a top surface, and the first, second and third contact sections are respectively formed at the top surface of the first, second and third modules, and said first, second and third contact sections receive a printed circuit board.

8. The connector assembly of claim 1, wherein said engagement structures of said first, second and third modules each comprise a projection and said first, second and third engagement structures of said elongated plate each comprise a slot.

9. The connector assembly of claim 1, wherein each of said first, second and third modules are substantially rectangular or square in shape.

10. The connector of claim 1, wherein the first, second and third contact sections receive electrical contacts.

11. A connector assembly comprising:

a plurality of modules each having a top surface, a first side and a second side substantially opposite the first side and at least one engagement structure at one of the first and second sides, wherein said plurality of modules are aligned such that the top surfaces of the plurality of modules are coplanar with one another and said plurality of modules form at least one row and at least one column; and, an elongated plate having a plurality of engagement structures removably engaging the at least one engagement structure of the modules in the at least one row and the modules in the at least one column.

12. The connector assembly of claim 11, wherein said plurality of modules comprises a first module, a second module, a third module and a fourth module, and said at least one row comprises a first row having the first and second modules and a second row comprising the third and fourth modules and said at least one column comprises a first column having the first and third modules and a second column having the second and fourth modules.

13. The connector assembly of claim 11, wherein said at least one row is substantially perpendicular to said at least one column.

14. The connector assembly of claim 11, wherein said at least one engagement structure of said plurality of modules comprises a projection and said plurality of engagement structures of said elongated plate comprises a slot.

15. The connector assembly of claim 11, wherein each of said plurality of modules are substantially rectangular or square in shape.

16. The connector of claim 11, wherein the first, second and third contact sections are at a top of the first, second and third modules, respectively.

17. The connector assembly of claim 11, further comprising a plurality of rows and a plurality of columns.

18. An engagement device for engaging a plurality of modules each having a top surface, a first side and a second side substantially opposite the first side and at least one engagement structure at one of the first and second sides, the plurality of modules being aligned to form at least one row and at least one column, said engagement device comprising:

an elongated plate;

a plurality of engagement structures removably engaging the at least one engagement structure of the modules in the at least one row and the modules in the at least one column so that the top surfaces of the plurality of modules are coplanar with one another.

19. A method comprising:

providing a first module having a top surface, at least one side and an engagement structure at the at least one side, the first module having a central horizontal axis and a central vertical axis;

providing a second module having a central horizontal axis aligned substantially with the central horizontal axis of said first module, said second module having a top surface, at least one side and an engagement structure at the at least one side, the top surface of the second module being coplanar with the top surface of the first module;

providing a third module having a central vertical axis aligned substantially with the central vertical axis of said first module, said third module having a top surface, at least one side and an engagement structure at the at least one side, the top surface of the third module being coplanar with the top surface of the first and second modules; and, providing an elongated plate having a first, second and third engagement structure;

removably engaging the first engagement structure with the engagement structure of said first module;

removably engaging the second engagement structure with the engagement structure of said second module; and removably engaging the third engagement structure with the engagement structure of said third module.

20. The method of claim 19, wherein the first, second and third modules each have a body formed of an insulative material.

21. The method of claim 19, wherein said board comprises a printed circuit board.

22. The method of claim 19, wherein said engagement structures of said first, second and third modules each comprise a projection and said first, second and third engagement structures of said elongated plate each comprise a slot.

23. The method of claim 19, wherein each of said first, second and third modules are substantially rectangular or square in shape.

24. A connector assembly comprising:

a first module having a top surface, a first side with an engagement structure and a second side;

a second module having a top surface, a first side with an engagement structure and a second side, wherein the second side of said second module is substantially aligned with the second side of said first module along a first plane, and the top surface of said first module is coplanar with the top surface of said second module; and, an elongated plate having a first engagement structure removably engaging the engagement structure of said first module and a second engagement structure removably engaging the engagement structure of said second module to thereby removably engage said first module and said second module.

25. The connector assembly of claim 24, wherein the second side of said first and second modules does not have any engagement structure.

26. The connector assembly of claim 24, wherein the second side of said first module faces the second side of said second module.

27. The connector assembly of claim 24, wherein the first side of said first module is substantially perpendicular to the second side of said first module, the first side of said second module is substantially perpendicular to the second side of said second module, the first side of said first module is substantially parallel to the first side of said second module, and the second side of said first module is substantially parallel to the second side of said second module.

28. The connector assembly of claim 24, wherein said first and second modules each have a top that receives at least one connector.

* * * * *